United States Patent [19]

Schäffeler

[11] 4,442,328

[45] Apr. 10, 1984

[54] ELECTRICAL SWITCH

[75] Inventor: Alois Schäffeler, Spaichingen, Fed. Rep. of Germany

[73] Assignee: Marquardt GmbH, Fed. Rep. of Germany

[21] Appl. No.: 396,365

[22] Filed: Jul. 8, 1982

[30] Foreign Application Priority Data

Jul. 8, 1981 [DE] Fed. Rep. of Germany ..... 3126816

[51] Int. Cl.[3] ..... H01H 15/18; H01H 21/40

[52] U.S. Cl. ..... 200/76; 200/68.1; 200/157; 200/67 A

[58] Field of Search ..... 200/76, 67 A, 67 B, 200/67 C, 67 E, 67 R, 157, 243, 250, 67 AA, 67 G, 68; 74/100 R

[56] References Cited

U.S. PATENT DOCUMENTS

| | | | |
|---|---|---|---|
| 2,798,127 | 7/1957 | Roeser | 200/68 |
| 2,841,661 | 7/1958 | Wintle | 200/76 |
| 2,951,130 | 8/1960 | Mason | 200/67 G |
| 3,290,463 | 12/1966 | Johnson | 200/76 |
| 3,312,801 | 4/1967 | Schleicher | 200/68 |
| 3,330,924 | 7/1967 | Larkin | 200/67 A |
| 3,471,663 | 10/1969 | Farrell et al. | 200/67 G |
| 3,766,348 | 10/1973 | Johnson | 200/157 |
| 4,121,069 | 10/1978 | Lang | 200/67 A |

FOREIGN PATENT DOCUMENTS

| | | | |
|---|---|---|---|
| 1285593 | 12/1968 | Fed. Rep. of Germany | 200/67 B |
| 3030451 | 12/1971 | Fed. Rep. of Germany | 200/76 |
| 3031364 | 1/1972 | Fed. Rep. of Germany | 200/67 B |
| 2716483 | 10/1978 | Fed. Rep. of Germany | 200/76 |

*Primary Examiner*—Stephen Marcus
*Assistant Examiner*—Ernest G. Cusick
*Attorney, Agent, or Firm*—McGlew and Tuttle

[57] ABSTRACT

A slide held in its initial position by a helical tension spring, carries at least one contact bridge, comprising a pair of movable contacts which cooperate with opposite contacts preferably contacts that are fixed to a housing. Between the slide and an operating plunger, a substantially C-shaped snap spring is clamped in inclined position, by which the slide and the operating plunger are retained in their initial positions.

Upon shifting the operating plunger in a selected direction, the inclined spring is righted and, after passing its neutral position, displaces the slide and the parts supported thereon abruptly against the fixed contacts.

A particularly advantageous switching characteristic (shortening of the operating distance in forward switching) is obtained by providing that the side portions of the C-shaped snap spring butt against a stop in the housing, so that the tilting radius of the snap spring is reduced.

13 Claims, 7 Drawing Figures

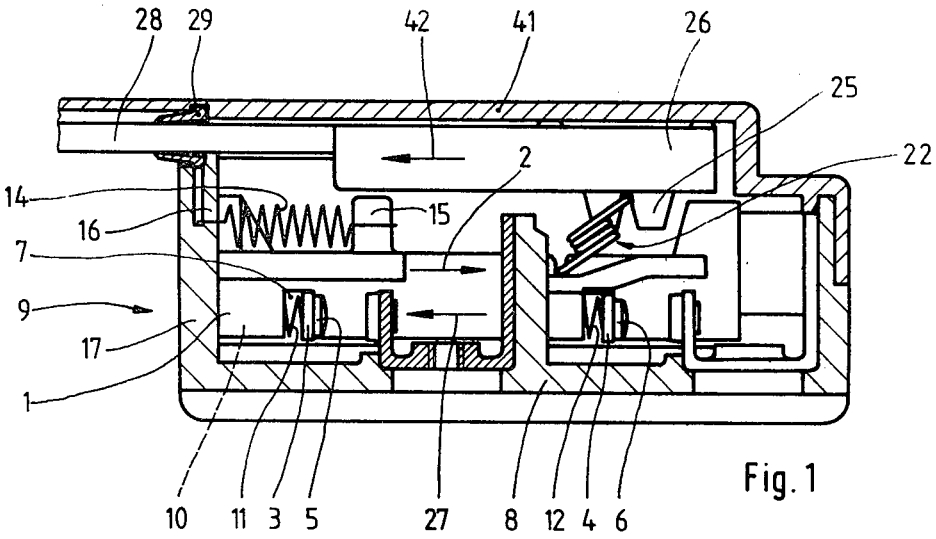
Fig. 1
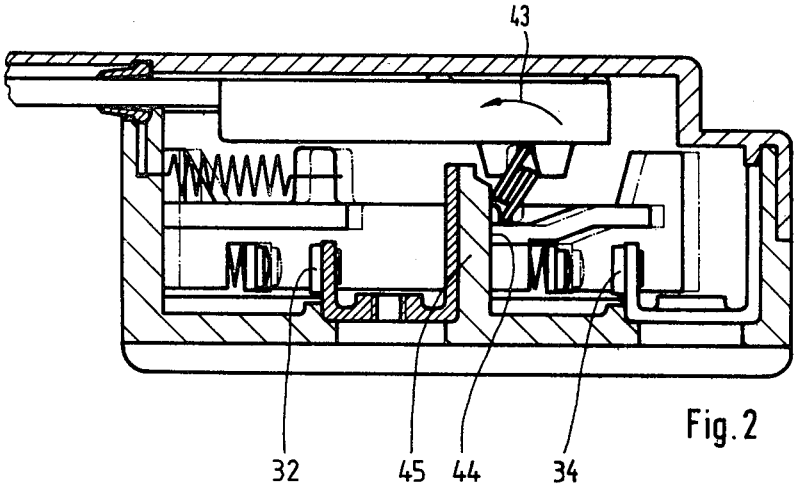
Fig. 2
Fig. 3
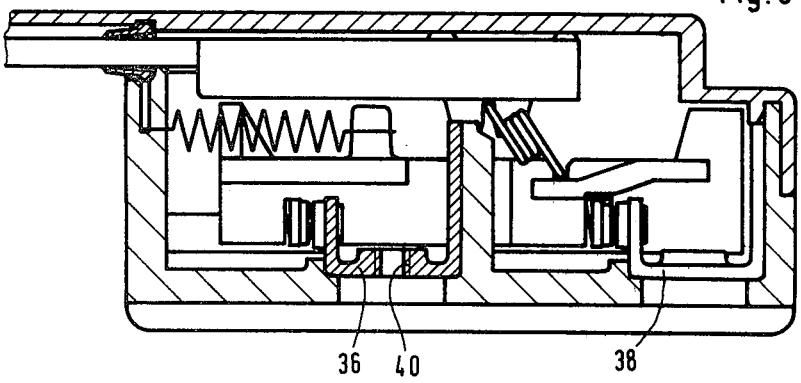

ELECTRICAL SWITCH

FIELD AND BACKGROUND OF THE INVENTION

The invention relates to an electrical switch comprising a slide which is mounted for displacement in a housing and is movable between two end positions by means of an operating member and carries at least one contact bridge bridging a pair of fixed contacts.

Switches of this kind are known in most various designs, mostly in the form of button-operated devices. As a rule, they comprise two contact bridges which are spaced apart from each other in the direction of displacement of the slide and, if two-pole make or break contacts are concerned, move into their make or break positions conjointly. It is also conceivable to break one circuit and simultaneously close another, i.e. to design the switch as a throw-over switch.

Since such switches are frequently employed in electrically operated hand tools, rugged construction and miniaturization are particularly appreciated. This leads to relatively small contact clearances and, as a rule, small-size contact bridges.

SUMMARY OF THE INVENTION

The invention is directed to a further development of an electrical switch of the above-mentioned kind, which permits a relatively short contact travel and a maximum contact clearance, making the switch suitable particularly also for opening and closing DC current circuits. In spite of that, the housing size of the switch is to be kept within limits making it usable for mounting in an electrically operated hand tool.

An object of the present invention is thus to provide an electrical switch having a slide which is mounted for displacement in a housing and is movable between two end positions by means of an operating member and carries at least one contact bridge bridging a pair of fixed contacts, a substantially C-shaped snap spring clamped between the side and an operating plunger that is shiftable within, and parallel to the housing, the snap spring being mounted for tilting on both the slide and the plunger while extending in a plane transverse to planes of displacement of the slide in the plunger and, in two end positions, being inclined relative to a nuetral plane, in which, by shifting the operating plunger the snap spring is tiltable in the direction of its neutral position.

The C-shaped snap spring, for example a so called double leg spring, may be relatively strong, so that a powerful contact pressure is obtained. Relatively large displacements of the slide may thereby be effected at the same time, with the result of a large contact clearance. On the other hand, the snapping into the other position may be brought about by a relatively short movement of the operating member. Further, such a switching mechanism is relatively simple in construction and thus rugged and long-lived. The assemblage or a repair if necessary, are done without difficulties. This switch therefore meets the requirements imposed thereon, which makes it particularly well suitable for being employed in connection with DC current. Its use is not restricted thereto, however.

While switching, the C-shaped snap spring, particularly a double leg spring, is moved from one of its oblique positions into a labile intermediate position and then snaps automatically into the other oblique position.

During this motion, it takes the slide along into the switched-over position. With the two oblique positions being equally inclined relative to the intermediate position, equal displacements of the slides or of the operating plunger which moves the slide indirectly through the snap spring, are necessary to effect the forward and backward switching. However, since a minimum contact travel is sought in accordance with the objective of the invention, and since this applies to the manual actuation of the bistable switch, for example, a better solution of the problem is obtained if, according to a development of the invention, the hysteresis of such a switch is changed to the effect that at least during a break of contact, the side portions of the snap spring are displaceable each against a stop provided on the housing in their zone of displacement. This applies to a switch having contacts which are normally open. A similar design, of course, may be provided in switches having contacts that are normally closed. While actuating the switch, the side portions of the C-shaped snap spring butt against their housing stops before the snap spring reaches its neutral or labile position and thus, of course, before the switching mechanism snaps over. This shortens the lever arm effective in tilting the snap spring and causes the slide to move in the switching direction before the labile position of the snap spring is reached. Since the stop is located between the two fulcrums of the snap spring on the slide and on the operating plunger, the single-armed lever becomes in this way a two-armed lever, because the spring is now put upright and simultaneously tilted at both its sides in the same direction about the housing stops as an intermediate fulcrum. Consequently, the stops must be dimensioned and located so as to ensure that the spring still can reach its labile intermediate position.

Another embodiment of the invention provides that each of the contact bridges is spring loaded in the closing direction of the switch. This makes possible a certain overtravel of the slide after the accomplished switching, and, in addition, an exact adjustment of the contact bridge relative to the fixed contacts which means that the tolerance requirements of the fixed contacts can be reduced. Each contact bridge advantageously bears by its central portion against a helical compression spring which is accommodated in a recess of the slide, with the contact bridge projecting laterally beyond the recess. To prevent the contact bridge from lateral displacement, transversely to the longitudinal axis of the helical compression spring, a small protuberance is advantageously provided at the contact bridge side remote from the contacts, which engages the respective end of the spring.

Another form of the inventive switch is characterized by the provision of a spring, particularly a helical tension spring, by which the slide is held in its end position in which the electric circuit is open. This spring makes the switch into a safety switch, since in the event of a breakage of the snap spring, it prevents the normally-open contacts from closing. In addition, in the initial position of the switch, this tension spring causes the slide to apply against a housing stop, so that an actuation immediately results in a tilting of the snap spring or double leg spring. If a switch with normally closed contacts is concerned, the contact can be broken upon a failure of the snap spring.

Another embodiment of the invention provides that the helical tension spring is accommodated in the space between the slide and the operating plunger, while the contact bridge and the helical compression spring thereof are mounted between the slide and the bottom portion of the switch housing. In this embodiment, the slide covers all of the contacts in any switching position. The fixed contacts are adjacent the housing bottom and they may be provided directly on the switch terminal elements which extend through the housing bottom or are accessible therethrough.

In a further development of the invention, the operating plunger is mounted for shifting in an upper part or cover of the housing and carries a forked driver engaging over the back of the substantially C-shaped snap spring, with the free leg ends of the snap spring which project approximately against each other, each engaging a groove-shaped recess which is open toward the housing cover or the like. This substantially facilitates and accelerates the assemblage of the switch since only an alignment of the driver with the back of the snap spring is needed before the cover is placed on the lower part of the housing and connected thereto. The side portions of the snap spring are advantageously formed by at least one turn of the spring material. In particular, about three such turns are provided. In the manner of a torsion spring, the turns tension the snap spring as soon as, while putting in place the cover, the back of the snap spring is pushed down against the free C-leg ends. In this way, the spring is prestressed to an extent necessary for a continuous, powerful switching.

According to another development of the invention, the two groove-shaped recesses of the slide are offset relative to each other by about a groove width in the direction of displacement of the slide, and the free C-leg ends of the snap spring are misaligned with each other by about the same distance. This makes it possible to insert the spring in advance of the final assemblage of the switch, and enables the free C-leg ends of the spring to move inwardly past each other while the spring is tensioned.

In accordance with still another development of the invention, the free end of the operating plunger is coupled to a spring loaded actuating lever or button which is pivotally mounted on the housing cover of the like, so that the shifting can be effected through a pivotal motion. Pivotally mounted actuating buttons or levers are preferred on electrically operated hand tools and a switch thus equipped is monostable, due to the spring loading of the button. In the mentioned application, the concerned switch is a normally open one.

Advantageously, such kinematic conditions are provided that upon pivoting the actuating button, the operating plunger moves approximately in a stright line in the direction of its longitudinal axis.

The cover or the like and the lower part of the housing are connected to each other advantageously by positive locking, particularly with the cover engaging over the lower part.

BRIEF DESCRIPTION OF THE DRAWINGS

One embodiment of the invention is shown in the drawings in which:

FIG. 1 is a longitudinal sectional view of a switch in its initial position;

FIG. 2 shows the switch in a position just before the movable parts snap over;

FIG. 3 shows the switch in the switched-over position;

DESCRIPTION OF THE PREFERRED EMBODIMENT

Figure 5:
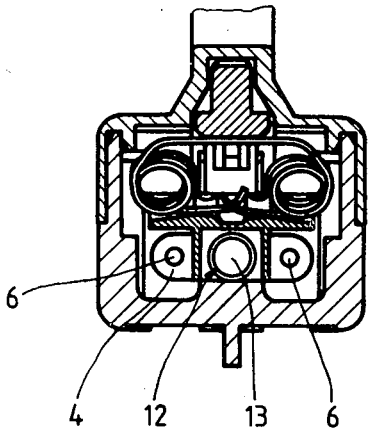
FIG. 5 is a sectional view taken through FIG. 1.
Figure 6:
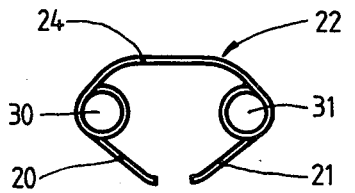
FIGS. 6 and 7 show the C-shaped snap spring in its form before assemblage and after being put in place.

In the shown embodiment, the electrical switch is designed as a double switch, i.e. two contact bridges 3 and 4 each carrying a pair of contacts 5,6 are mounted on a slide 1 of the switch one after the other in the direction of displacement 2. To this end, and for each of the contact bridges, slide 1 is provided with a slot-shaped recess 7 and a pocket 10 which is open toward the bottom 8 of the housing 9 of the switch and in which a helical compression spring 11,12 is received by which the respective bridge 3,4 is pushed into contact with the right-hand boundary of the slot-shaped recess, as viewed in FIGS. 1 through 3. A small, centrally arranged raised portion 13 of contact bridge 3,4 on the side remote from movable contacts 5,6 serves the purpose of centering helical compression spring 11,12 (see FIG. 5).

A helical tension spring 14 which is attached by its front end, considered in the direction of displacement 2, to a stud 15 of slide 1 and by its rear end to a retaining element 16 of switch housing 9, pulls the slide 1 against the rear wall 17 of the switch, in the direction opposite to arrow 2.

Figure 4:
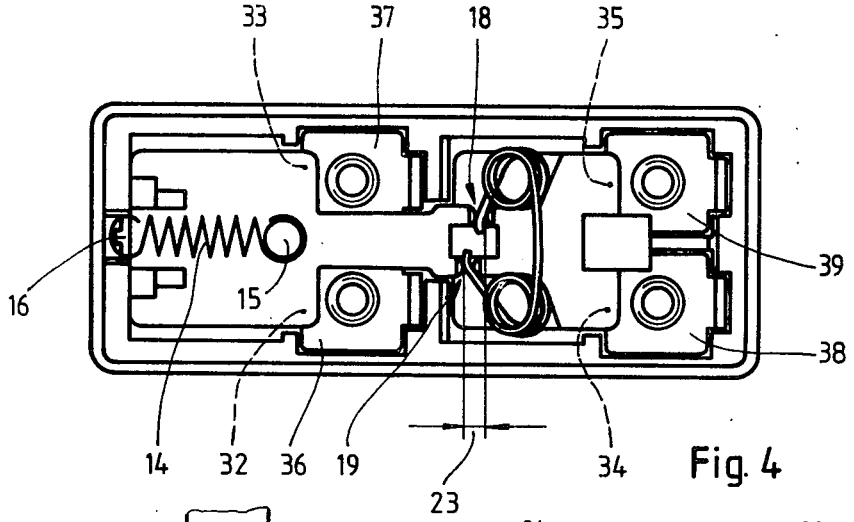
FIG. 4 is a top plan view of the switch, with the cover and the operating member omitted.
Figure 7:
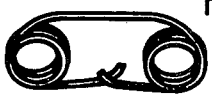

At the front end of slide 1, considered in the direction of displacement 2, two groove-shaped recesses 18 and 19 are provided which are engaged each by one of the two free leg ends 20 and 21 of a substantially C-shaped snap spring 22 (FIG. 4). These two groove-shaped recesses 18,19 are offset relative to each other by a distance 23 in the direction of displacement 2, and the two free leg ends 20 and 21 of the snap spring 22 in unloaded state, are laterally misaligned with each other by about the same distance. This enables the free leg ends to move laterally past each other into their position under-load (FIG. 7). The back 24 of the snap spring is engaged between the prongs of a forked driver 25 which is provided about at the inner end of an operating plunger 26. In the initial position of the switch (FIG. 1), a plane passing through C-shaped snap spring 22 is inclined for example relative to rear wall 17 of the switch. Consequently, operating plunger 26 is thereby loaded in the direction of arrow 2, and slide 1 is loaded in the direction of arrow 27. Operating plunger 26 is further provided with a cylindrical shank 28 which extends to the outside through a sealing sleeve 29 which is retained in the housing of the switch. The leg portions 30 and 31 of C-shaped snap spring 22 are formed, for example, each by three wire turns, as clearly shown in FIG. 7. Within the switch housing, fixed contacts 32 and 33, or 34 and 35, are provided cooperating with contact pairs 5 or 6 of contact bridges 3,4. Preferably, these fixed contacts take the form of contact rivets which are supported on terminal elements, particularly U-shaped ones 36,37 or 38,39. As shown in FIGS. 1 through 3 by way of example, the terminal elements are substantially U-shaped and the web of the U is provided with a taphole 40 which permits a connection for the electrical conductor to be screwed thereto. Terminal elements 36 to 39 are clamped in place in corresponding recesses of the switch housing. In an assembled state, the inner parts of the switch and/or cover 41 prevent them from being pushed out.

By shifting operating plunger 26 in the direction of arrow 42, its forked driver 25 tilts the substantially C-shaped snap spring 22 in the direction of arrow 43, so that the plane of the spring is more and more righted to a perpendicular extension relative to the direction of displacement 2, and the spring tension increases at the same time by the compression. As soon as about the position shown in FIG. 2 in dash-dotted lines is reached, the spring comes into an unstable balanced position, and, upon a slight further movement in the direction of arrow 42, slide 1 along with the parts carried thereon jumps into the switched-over position shown in FIG. 3. In consequence, movable contact pairs 5,6 impinge on their associated fixed contacts 32,33 or 34,35. Helical compression springs 11 and 12 provide an allowance for a certain overtravel.

This switch is bistable in itself, however, it may be transformed into a monostable one by providing an actuator which is coupled to the outer end of operating plunger 26 and, preferably, pivotable against the action of a return spring.

A certain return force which, however, is not sufficient, is exerted by helical tension spring 14. FIG. 3 shows the opposite inclined position of C-shaped snap spring 22. Further, FIG. 2 illustrates a particular design with which upon actuating the switch, the leg portions 30 and 31 of C-shaped snap spring, prior to the snap-over, butt against a stop 44 formed by a wall 45 of the switch, whereby the travel in this switching direction is shortened. On the other hand, as shown in FIG. 1, for example, this switch has a very large contact clearance which makes it particularly suitable for DC current circuits. Cover 41 of the housing, preferably accommodating sealing sleeve 29 and supporting operating plunger 26, is connected to lower part of switch housing 9 by snap-in or other positive locking, while engaging thereover.

While a specific embodiment of the invention has been shown and described in detail to illustrate the application of the principles of the invention, it will be understood that the invention may be embodied otherwise without departing from such principles.

I claim:

1. An electrical switch comprising:

a housing;

a slide mounted for displacement in said housing and movable between two end positions, said slide including at least one contact bridge for bridging a pair of fixed contacts connected to said housing;

an operating plunger shiftable within said housing;

a snap spring engaged between said slide and said operating plunger, said snap spring mounted for pivoting on both said slide and said plunger and movable into a neutral plane which is transverse to planes of displacement of said slide and said plunger, said snap spring having two end positions in which said snap spring is inclined relative to said neutral plane and into which positions said snap spring is movable by shifting said operating plunger;

a tension spring connected between said slide and said housing for biasing said slide into one of its end positions in which said at least one contact bridge is out of engagement with said fixed contacts;

said housing includes a bottom, said plunger slidable parallel to said bottom, said tension spring comprising a helical spring and provided in a space between said slide and said plunger;

a helical compression spring connected between said contact bridge and said slide for spring loading said contact bridge with engagement between said contact bridge and said fixed contacts, said contact bridge connected to said slide adjacent said housing bottom;

said housing including an upper part, said operating plunger mounted for shifting in said upper part, said operating plunger including a forked driver, said snap spring comprising a C-shaped snap spring having leg portions and a back connected between said leg portions, said snap spring back engaged in said forked driver, said snap spring including free end portions extending from said leg portions and toward each other, said slide including a groove shaped recess for receiving each end portion of said snap spring facing said upper part.

2. A switch according to claim 1, wherein one groove shaped recess is offset relative to the other in a direction of displacement of said slide so that said end portion of said snap spring are misaligned with each other.

3. A switch according to claim 2, wherein one groove shaped recess is offset by about an amount equal to the width of said one groove shaped recess.

4. A switch according to claim 1, wherein each of said leg portions of said snap spring comprise at least one turn of said spring material.

5. A switch according to claim 1, wherein said housing includes a cover comprising said upper part, said cover positively locked to a remainder of said housing.

6. An electrical switch comprising:

a housing;

a slide mounted for displacement in said housing and movable between two end positions, said slide including at least one contact bridge for bridging a pair of fixed contacts connected to said housing;

an operating plunger shiftable within said housing;

a snap spring engaged between said slide and said operating plunger, said snap spring mounted for pivoting on both said slide and said plunger and movable into a neutral plane which is transverse to planes of displacement of said slide and said plunger, said snap spring having two end positions in which said snap spring is inclined relative to said neutral plane and into which positions said snap spring is movable by shifting said operating plunger;

said snap spring comprising a C-shaped snap spring having a back and a pair of leg portions connected to said back;

said housing including a housing stop disposed in a path of displacement of said leg portions, said housing stop positioned to engage said leg portions of said snap spring with shifting of said operating plunger when said at least one contact bridge is out of engagement with said fixed contacts.

7. A switch according to claim 6, including biasing means connected between said slide and said at least one contact bridge for spring loading said contact bridge with engagement of said contact bridge with said fixed contacts.

8. A switch according to claim 7, wherein said biasing means includes a helical compression spring, said slide including a recess for containing said compression spring, said at least one contact bridge projecting beyond said recess.

9. A switch according to claim 6, wherein said operating plunger is shiftable in a direction parallel to a bottom of said housing.

10. An electrical switch comprising:

a housing;

a slide mounted for displacement in said housing and movable between two end positions, said slide including at least one contact bridge for bridging a pair of fixed contacts connected to said housing;

an operating plunger shiftable within said housing; and a snap-spring engaged between said slide and said operating plunger, said snap-spring mounted for pivoting on both said slide and said plunger and movable into a neutral plane which is transverse to planes of displacement of said slide and said plunger, said snap spring having two end positions in which said snap spring is inclined relative to said neutral plane and into which positions said snap spring is movable by shifting said operating plunger, said snap spring being C-shaped with a back and a pair of leg portions connected to opposite ends of said back, at least one of said leg portions including a coil spring portion, said leg portion being resiliently bent toward said back when said snap spring is in said neutral plane.

11. A switch according to claim 10, wherein said back of said snap spring is pivotally mounted to said plunger and each of said leg portions include an end portion pivotally mounted to said slide.

12. A switch according to claim 11 wherein each of said leg portions includes a coil spring portion between said back and each respective one of said end portions.

13. A switch according to claim 12, wherein said housing includes a stop disposed in a path of movement of at least one of said leg portions for engaging said at least one of said leg portions with shifting of said operating plunger when said at least one contact bridge is out of engagement with said fixed contacts.

* * * * *